US007484366B2

(12) United States Patent
Mori

(10) Patent No.: US 7,484,366 B2
(45) Date of Patent: Feb. 3, 2009

(54) MULTISTAGE STIRLING ENGINE

(75) Inventor: Masayoshi Mori, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 71 days.

(21) Appl. No.: 10/553,237

(22) PCT Filed: Apr. 28, 2004

(86) PCT No.: PCT/JP2004/006151

§ 371 (c)(1),
(2), (4) Date: Jan. 11, 2007

(87) PCT Pub. No.: WO2004/101983

PCT Pub. Date: Nov. 25, 2004

(65) Prior Publication Data

US 2007/0169477 A1 Jul. 26, 2007

(30) Foreign Application Priority Data

May 13, 2003 (JP) ..... 2003-134131
Apr. 6, 2004 (JP) ..... 2004-112485

(51) Int. Cl.
*F01B 29/10* (2006.01)

(52) U.S. Cl. ..... 60/517; 60/525

(58) Field of Classification Search ..... 60/517, 60/520, 525
See application file for complete search history.

(56) References Cited

U.S. PATENT DOCUMENTS 3,115,014 A * 12/1963 Hogan ..... 62/6
3,379,026 A * 4/1968 Cowans ..... 62/6
3,812,682 A * 5/1974 Johnson ..... 62/6
4,020,635 A * 5/1977 Joynes et al. ..... 60/525
4,148,195 A * 4/1979 Gerstmann et al. ..... 62/6

FOREIGN PATENT DOCUMENTS

JP 1-294946 11/1989
JP 2000-27701 1/2000
JP 2000-146336 5/2000

* cited by examiner

*Primary Examiner*—Hoang M Nguyen
(74) *Attorney, Agent, or Firm*—Kratz, Quintos & Hanson, LLP

(57) ABSTRACT

A multistage Stirling engine 1 mounted on an automobile provided with an internal combustion engine has two cylinders 4 and 5. Displacer pistons 6 and 7 and power pistons 8 and 9 are slidably fitted in the two cylinders 4 and 5, respectively. The exhaust gas discharged from the internal combustion engine and serving as a heating fluid flows sequentially through the cylinders 4 and 5 to heat helium gas serving as a working fluid of the Stirling engine. The cylinders 4 and 5 are disposed parallel to each other. Heaters 16 and 17, regenerative heat exchangers 18 and 19, and coolers 20 and 21 are installed between the cylinders 4 and 5. The multistage Stirling engine is flat and compact.

7 Claims, 7 Drawing Sheets

α TYPE

β TYPE

γ TYPE

DOUBLE ACTING TYPE

MULTISTAGE STIRLING ENGINE

TECHNICAL FIELD

The present invention relates to a compact multistage Stirling engine in which a heating fluid heats a plurality of cylinders in series and, more particularly, to an automotive multistage Stirling engine using the exhaust gas discharged from an internal combustion engine mounted on an automobile as a heating fluid.

BACKGROUND ART

Stirling engines are classified roughly into those of four groups shown in FIGS. 7A to 7D.

(1) An α-type Stirling engine shown in FIG. 7A has a series assembly of a heater H, a regenerative heat exchanger R and a cooler C arranged in that order, two cylinders $S_1$ and $S_2$, and power cylinders $PP_1$ and $PP_2$ slidably fitted in the cylinders $S_1$ and $S_2$, respectively. The series assembly of the heater H, the regenerative heat exchanger R and the cooler C is connected to top spaces in the cylinders $S_1$ and $S_2$.

(2) A β-type Stirling engine shown in FIG. 7B has a cylinder S, a displacer piston DP fitted in the cylinder S, a power piston PP connected in series to the displacer piston DP and fitted in the cylinder S, and a series assembly of a heater H, a regenerative heat exchanger R and a cooler C arranged in that order. The series assembly of the heater H, the regenerative heat exchanger R and the cooler C is connected to a space $S_A$ extending above the displacer piston DP in the cylinder S and a space $S_B$ extending under the displacer piston DP. The space $S_A$ and the space $S_B$ communicate with each other by means of the series assembly of the heater H, the regenerative heat exchanger R and the cooler C.

(3) A γ-type Stirling engine shown in FIG. 7C has a displacer cylinder DS, a displacer piston DP fitted in the displacer cylinder DS and defining space. $DS_A$ and $DS_B$ in the displacer cylinder DS, a power cylinder PS, a power piston PP fitted in the power cylinder PS and defining a space $DS_A$ in the power cylinder PS, and a series assembly of a heater H, a regenerative heat exchanger R and a cooler C. The series assembly of the heater H, the regenerative heat exchanger R and the cooler C is connected to the two spaces $DS_A$ and $DS_B$. The space $DS_B$ in the cylinder DS and the space $PS_A$ in the cylinder PS communicate with each other.

(4) A double-acting Stirling engine shown in FIG. 7D has four staggered cylinders $S_1$, $S_2$, $S_3$ and $S_4$, four series assemblies each of a heater H, a regenerative heat exchanger R and a cooler C, rotating swash plates, not shown, placed in middle parts of the cylinders $S_1$, $S_2$, $S_3$ and $S_4$, respectively, and power pistons $PP_1$, $PP_2$, $PP_3$ and $PP_4$ placed in the cylinders $S_1$, $S_2$, $S_3$ and $S_4$ and interlocked with the swash plates, respectively. Each series assembly of the heater H, the regenerative heat exchanger R and the cooler C is connected to a top space $S_A$ in one of the adjacent cylinders and a bottom space $S_B$ in the other cylinder.

A waste heat utilizing system disclosed in JP 1-294946 A includes a water-cooled internal combustion engine and two β-type Stirling engines combined with the water-cooled internal combustion engine. One of the two β-type Stirling engines operates on heat provided by cooling water for cooling the water-cooled internal combustion engine and the other β-type Stirling engine operates on heat provided by an exhaust gas discharged from the water-cooled internal combustion engine.

This known waste heat utilizing system using the cooling water and the exhaust gas as heat sources for the two β-type Stirling engines needs complicated piping having high sealing effect. Therefore, it is difficult to form the waste heat utilizing system in small, lightweight construction at a low cost.

Although the waste heat utilizing system is provided with the two β-type Stirling engines, the output and efficiency were low because one of the β-type Stirling engines uses, as a heat source, the cooling water of a temperature on the order of 100° C. lower than that of the exhaust gas.

The present invention has been made to overcome those difficulties and it is therefore an object of the present invention to provide a low-cost, lightweight, compact, reliable multistage Stirling engine and capable of generating a high output at a high efficiency.

DISCLOSURE OF THE INVENTION

The present invention provides a multistage Stirling engine comprising: a plurality of cylinders each internally holding a working fluid and provided with a displacer piston and a power piston disposed in series and fitted in the cylinder; a plurality of heaters respectively combined with the cylinders to heat the working fluid contained in the plurality of cylinders and using a high-temperature heating fluid provided by a heat source; and a heating fluid passage for passing the heating fluid sequentially through the heaters; wherein a plurality of heat exchangers are provided which comprises the plurality of heaters, a plurality of coolers for cooling the working fluid within the plurality of cylinders, and a plurality of regenerators each interposed between one of the heaters and one of the coolers; each of the plurality of heaters is connected to one end of each of the plurality of cylinders; each of the plurality of coolers is connected to the other end of each of the plurality of cylinders; and the plurality of heat exchangers are interposed between adjacent ones of the plurality of cylinders.

In the multistage Stirling engine according to the present invention, the high-temperature heating fluid flows sequentially through the plurality of heaters for heating the working fluid held in the plurality of cylinders to heat the working fluid. Therefore, the multistage Stirling engine, as compared with a single-stage Stirling engine provided with a single cylinder, is able to recover the energy of the heating fluid at a high recovery ratio to increase the output of the multistage Stirling engine.

Since the heat exchangers each including the heater, the regenerator and the cooler are interposed between adjacent ones of the plurality of cylinders, the multistage Stirling engine can be formed in simple, small, lightweight construction. The use of only the single type of heating fluid simplifies the construction and reduces costs.

The multistage Stirling engine according to the present invention, may further include output shafts connected to the displacer pistons and the power pistons fitted in the plurality of cylinders, a generator connected to the output shaft, and a case sealing the output shaft and the generator therein.

Thus, the output shafts of the multistage Stirling engine do not need to be provided with sealing means, are not subjected to abrasion that may act on the output shafts if the output shafts are provided with sealing means. Consequently, the output and durability of the multistage Stirling engine are improved, an easily leaking gas having a small atomic weight can be used as the working fluid, resistance against the flow of the working fluid can be reduced, and the increase in the operating cost due to the leakage of the working fluid can be avoided.

According to the present invention, the multistage Stirling engine may have an engine case and the case for sealing the output shaft and the generator may be a part of the engine case. Thus component members can be simplified, the number of component members can be reduced to form the multistage Stirling engine in compact, lightweight construction and cost reduction can be promoted.

Preferably, the heating fluid is an exhaust gas discharged from an internal combustion engine, and the passage for the heating fluid includes an upstream exhaust pipe extending on opposite sides of one of the cylinders and connected to opposite side parts of a heater combined with a same cylinder.

Thus the high-temperature exhaust gas is used as the heating fluid, and the heating fluid flows sequentially through the plurality of heaters. Consequently, the heat of the exhaust gas can be effectively used and can be efficiently converted into electric energy. Consequently, the thickness of the multistage Stirling engine can be reduced and the space between adjacent cylinders can be reduced to form the multistage Stirling engine in a small size.

Preferably, wherein the heating fluid passage includes a downstream exhaust pipe for carrying the exhaust gas after the exhaust gas has exchanged heat with the working fluid in one of the heaters, and the lower exhaust pipe extends on opposite sides of a cylinder adjacent to said one of the heaters and is connected to an exhaust manifold.

Consequently, the thickness of the multistage Stirling engine can be reduced and the space between adjacent cylinders can be reduced to form the multistage Stirling engine in a small size.

In the multistage Stirling engine according to a preferred embodiment of the present invention, the plurality of cylinders are disposed parallel to each other. Further, the output shafts connected to the respective displacer pistons and power pistons of the plurality of cylinders are aligned, and the generator is installed in alignment with the axes of the output shafts. The plurality of heat exchangers are united in a unit.

BEST MODE FOR CARRYING OUT THE INVENTION

A multistage Stirling engine in a first embodiment of the present invention will be described with reference to FIGS. 1 to 4.

A two-stage Starling engine 1 in a first embodiment of the present invention is combined with an automotive internal combustion engine, not shown. The Stirling engine 1 uses an exhaust gas discharged from the internal combustion engine and purified by an exhaust emission control device, not shown, as a heat source, uses cooling water cooled by a cooler included in the internal combustion engine as a heat sink and uses helium (He) gas as a working fluid.

Figure 1:
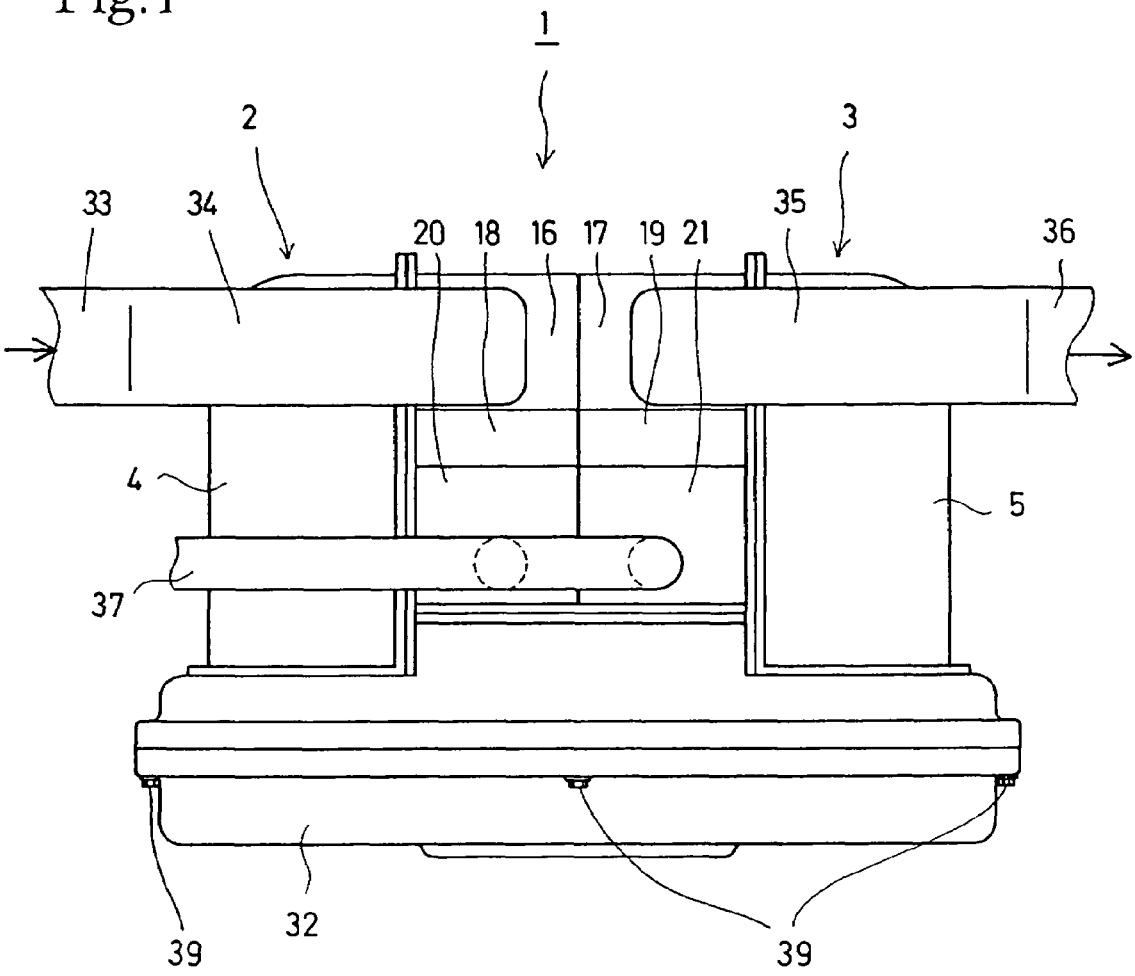
FIG. 1 is a side elevation of a multistage Stirling engine in a first embodiment of the present invention.
Figure 2:
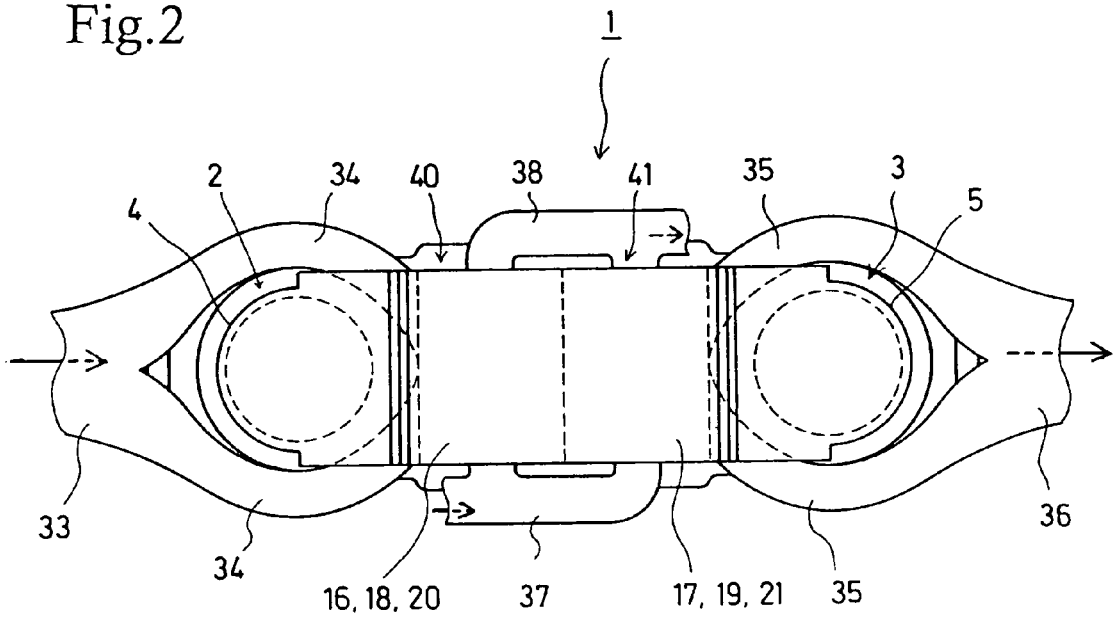
FIG. 2 is a plan view of the multistage Stirling engine shown in FIG. 1.
Figure 4:
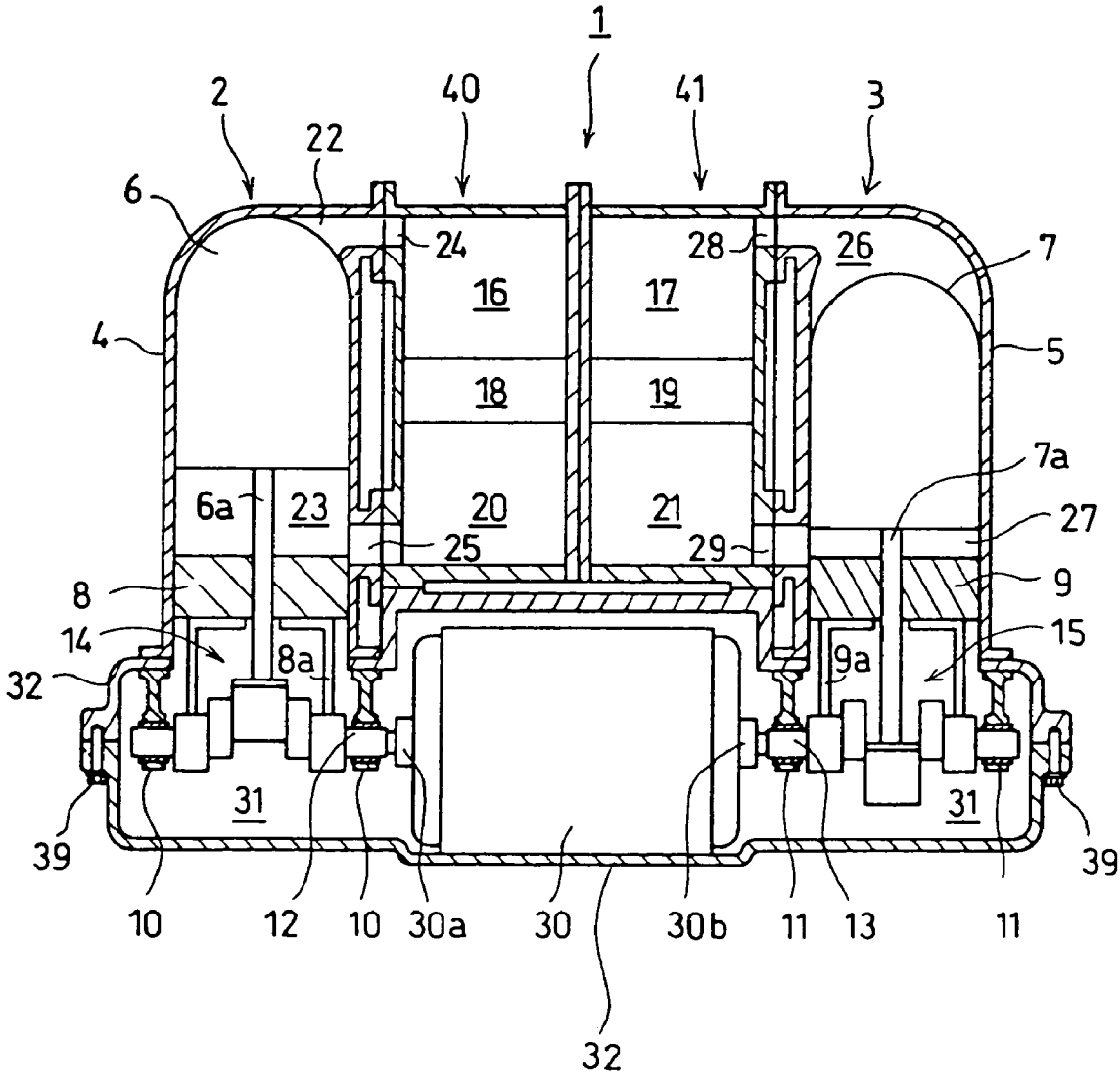
FIG. 4 is a longitudinal sectional view taken on the line IV-IV in FIG. 2.

Referring to FIGS. 1, 2 and 4, the two-stage Stirling engine 1 has a first-stage Stirling engine 2 having a vertical first cylinder 4, and a vertical second-stage Stirling engine 3 having a second cylinder 5. A first heat exchanger 40 and a second heat exchanger 41 are disposed between the first cylinder 4 and the second cylinder 5. The first cylinder 4 and the second cylinder 5 are set parallel to each other and are spaced apart by a distance substantially equal to the sum of the longitudinal dimensions of the first heat exchanger 40 and the second heat exchanger 41. As shown in FIG. 4, a first displacer piston 6 and a second displacer piston 7 are fitted slidably in upper parts of the first cylinder 4 and the second cylinder 5, respectively. A first power piston 8 and a second power piston 9 are fitted slidably in lower parts of the first cylinder 4 and the second cylinder 5, respectively. Piston rods 6*a* and 7*a* respectively connected to the first displacer piston 6 and the second displacer piston 7 slidably penetrate the first power piston 8 and the second power piston 9, respectively.

Two camshaft holders 10 are attached to the lower end of the first cylinder 4, and two camshaft holders 11 are attached to the lower end of the second cylinder 5. Camshafts 12 and 13 are supported for rotation on the pair of camshaft holders 10 and the pair of camshaft holders 11, respectively. The piston rod 6*a* of the first displacer piston 6 and the piston rod 8*a* of the first power piston 8 are interlocked with the camshaft 12 by a known interlocking mechanism 14, such as a crosshead mechanism, a rhombic mechanism or a Scotch yoke mechanism. The piston rod 7*a* of the second displacer piston 7 and the piston rod 9*a* of the second power piston 9 are interlocked with the camshaft 13 by a known interlocking mechanism 15 similar to the interlocking mechanism 14. The respective phases of the first displacer piton 6 and the second displacer piston 7 are advanced by about 90° with respect to those of the first power piston 8 and the second power piston 9, respectively. Further, there is a phase angle difference of 180° between the first displacer piston 6 and the second displacer piston 7.

A generator 30 is interposed between the camshafts 12 and 13. The generator 30 has rotating shafts 30*a* and 30*b* connected to the camshafts 12 and 13, respectively. The first-stage Stirling engine 2 and the second-stage Stirling engine 3 operate to drive the generator 30.

The first heat exchanger 40 and the second heat exchanger 41 are arranged longitudinally, i.e., in a lateral direction as viewed in FIG. 4, between the first cylinder 4 and the second cylinder 5. The first heat exchanger 40 has a first heater 16, a first regenerative heat exchanger 18 and a first cooler 20 arranged downward in that order. The second heat exchanger 41 has a second heater 17, a second regenerative heat exchanger 19 and a second cooler 21 arranged downward in that order. A helium gas passage is formed through the first heater 16, the first regenerative heat exchanger 18 and the first cooler 20 of the first heat exchanger 40. A helium gas passage is formed through the second heater 17, the second regenerative heat exchanger 19 and the second cooler 21 of the second heat exchanger 41.

The first displacer piston 6 divides the interior of the first cylinder 4 into a first upper chamber 22 and a first lower chamber 23. The first upper chamber 22 and the first lower chamber 23 communicate with the first heater 16, the first regenerative heat exchanger 18 and the first cooler 20 by way of connecting passages 24 and 25, respectively. The second displacer piston 7 divides the interior of the second cylinder 5 into a second upper chamber 26 and a second lower chamber 27. The second upper chamber 26 and the second lower chamber 27 communicate with the second heater 17, the second regenerative heat exchanger 19 and the second cooler 21 by way of connecting passages 28 and 29, respectively. The first upper chamber 22, the first lower chamber 23, the connecting passages 24 and 25, the second upper chamber 26, the second lower chamber 27 and the connecting passages 28 and 29 are filled up with high-pressure helium gas of a high pressure on the order of 100 atm.

A crankcase 32 defines a sealed crank chamber 31 extending under the first cylinder 4, the second cylinder 5, the first cooler 20 and the second cooler 21. The crankcase 32 has an upper part and a lower part, which are fastened together with bolts 39. The camshafts 12 and 13, the interlocking mechanisms 14 and 15 and the generator 30 are held in the crank chamber 31.

Referring to FIG. 2, an exhaust pipe 33 is provided for carrying the exhaust gas discharged from the internal combustion engine, not shown, and purified by the exhaust gas purifier, not shown. The exhaust pipe 33 extends toward the first-stage Stirling engine 2 and branches out into branch exhaust pipes 34. The branch exhaust pipes 34 extend horizontally on the opposite sides of a top part of the first-stage Stirling engine 2. The branch exhaust pipes 34 penetrate the right and the left side wall of the first heater 16, respectively, and the lower ends of the branch exhaust pipes 34 open into the exhaust gas passage in the first heater 16. The respective exhaust gas passages of the first heater 16 and the second heater 17 extend horizontally and are connected together. Branch exhaust pipes 35 extend on the opposite sides of a top part of the second cylinder 5 and have upstream ends connected to the right and left side walls of the second heater 17, respectively, and downstream ends connected to an exhaust manifold 36. A muffler, not shown, is connected to the downstream end of the exhaust manifold 36.

Figure 3:
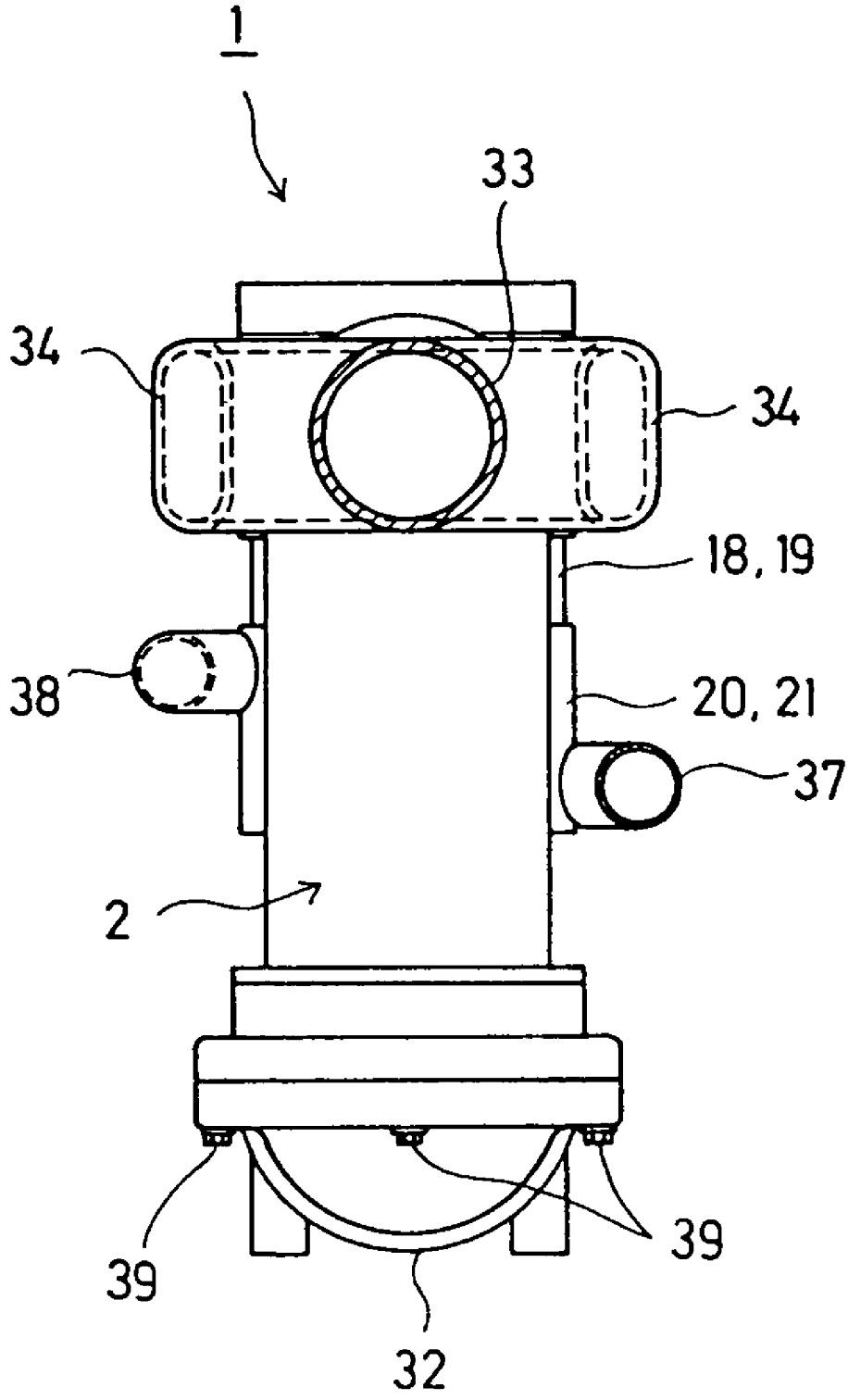
FIG. 3 is a front elevation of the multistage Stirling engine shown in FIG. 1.

Referring to FIG. 1, a cooling water pipe 37 connected to a radiator, not shown, for cooling the cooling water circulated through the internal combustion engine or another radiator, not shown, extends horizontally along the right side, as viewed in FIG. 3, of the first Stirling engine 2 toward the second Stirling engine 3. Parallel downstream end parts of the cooling water pipe 37 penetrate the right side walls of the first cooler 20 and the second cooler 21 and are connected to cooling water passages formed in the first cooler 20 and the second cooler 21, respectively. Parallel upstream end parts of a cooling water return pipe 38 penetrate the left side walls of the first cooler 20 and the second cooler 21 and are connected to the cooling water passages of the first cooler 20 and the second cooler 21, respectively.

Power generated by the generator 30 is used for driving motors for driving the accessories of the internal combustion engine, such as a compressor, a cooling water pump, a lubricating oil pump and a pump for pumping a power steering fluid. Excess power is used for charging a battery, not shown.

The multistage Stirling engine in the first embodiment is thus constructed as shown in FIGS. 1 to 4. The exhaust gas discharged from the internal combustion engine and purified by the exhaust gas purifier flows through the exhaust pipe 33 and the right and left branch exhaust pipes 34, and flows through the downstream end parts of the branch exhaust pipes 34 penetrating the right and left side walls of the first heater 16 into the first heater 16 and the second heater 17. The exhaust gas transfers heat to the high-pressure helium gas in the first heater 16 and the second heater 17. Then, the exhaust gas flows through a pair of branch exhaust pipes 35 connected to the right and left side walls of the second heater 17 into an exhaust manifold 36. Thus the helium gas vertically flowing in the first heater 16 and the second heater 17 is heated.

Cooling water cooled while flowing through a radiator, not shown, flows through the cooling water pipe 36 penetrating the right side walls of the first cooler 20 and the second cooler 21 into the first cooler 20 and the second cooler 21. The cooling water absorbs heat from the high-pressure helium gas vertically flowing in the first cooler 20 and the second cooler 21. After cooling the helium gas, the cooling water is discharged through the left side walls of the first cooler 20 and the second cooler 21 into the cooling water return pipe 38, The respective phases of the reciprocating motion of the first displacer piston 6 and the second displacer piston 7 are advanced by 90° with respect to the respective phases of reciprocating motion of the first power piston 8 and the second power piston 9, respectively. The phase angle between the first displacer piston 6 and the second displacer piston 7 is 180°. Therefore, in the first-stage Stirling engine 2 and the second-stage Stirling engine 3, the helium gas flows through the first heater 16, the second heater 17, the first regenerative heat exchanger 18, the second regenerative heat exchanger 19, and the first cooler 20 and second cooler 21 according to the variation of the respective volumes of the first upper cylinder chamber 22 and the second upper cylinder chamber 26 and the respective volumes of the first lower cylinder chamber 23 and the second lower cylinder chamber 27. Thus, the helium gas flows between the first upper cylinder chamber 22 and the second upper cylinder chamber 26, and the first lower cylinder chamber 23 and the second lower cylinder chamber 27. When the volume of the first upper cylinder chamber 22 increases, the pressure of the helium gas in the first upper cylinder chamber 22, the first lower cylinder chamber 23 and the connecting passages 24 and 25 increases and, consequently, the first power piston 8 is moved down by the pressure of the helium gas to drive the camshaft 12. When the volume of the second upper cylinder chamber 26 increases, the pressure of the helium gas in the second upper cylinder chamber 26, the second lower cylinder chamber 27 and the connecting passages 28 and 29 increases and, consequently, the second power piston 9 is moved down by the pressure of the helium gas to drive the camshaft 32. Thus the generator 30 is driven to generate power.

Power generated by the generator 30 is used for driving accessories, not shown or for charging a battery, not shown.

The high-temperature exhaust gas purified by the exhaust gas purifier, not shown, and flowing into the first heater 16 is used as a heat source for the first-stage Stirling engine 2. The temperature of the exhaust gas drops after the heat of the exhaust gas has been transferred to the helium gas in the first heater 16. Then, the exhaust gas flows into the second heater 17 and is used as a heat source for the second-stage Stirling engine 3. Since the high-temperature exhaust gas is used as heat sources at two stages, the two-stage Stirling engine 1 generates high power at high efficiency.

Since the respective first cylinder 4 and the second cylinder 5 of the first-stage Stirling engine 2 and the second-stage Stirling engine 3 are parallel to each other, the first heater 16, the second heater 17, the first regenerative heat exchanger 18, the second regenerative heat exchanger 19, the first cooler 20 and the second cooler 21 are stacked vertically in a close arrangement between the first cylinder 4 and the second cylinder 5. The crank chamber 31 is formed under the first cylinder 4, the second cylinder 5, the first cooler 20 and the second cooler 21, and the generator 30 is disposed in a middle part of the crank chamber 31. Therefore, the two-stage Stirling engine 1 is a compact structure having a shape resembling a flat rectangular solid having a small dimension with respect to a direction perpendicular to the sheet of FIG. 4. Consequently, the two-stage Stirling engine 1 can be easily installed in a narrow engine compartment of an automobile or in a dead space under a floor sheet.

The comparatively simple and compact two-stage Stirling engine 1 is lightweight and can be manufactured at low cost.

The first-stage Stirling engine 2, the second-stage Stirling engine 3, the first heater 16, the second heater 17, the first regenerative heat exchanger 18, the second regenerative heat exchanger 19, the first cooler 20, the second cooler 21 and the generator 30 are sealed in a single closed case and there is not any rotating or sliding shaft penetrating the case. Therefore, even if the high-pressure helium gas having a small molecular weight and a pressure as high as 100 atm. is used as the working fluid, the high-pressure helium gas will not leak into the atmosphere, the two-stage Stirling engine 1 does not need to be replenished with expensive helium gas and is able to operate at low operating cost. Since the working fluid is helium gas having a small molecular weight, power loss due to flow of the working fluid in the two-stage Stirling engine 1 is small and the output and the efficiency of the two-stage Stirling engine 1 can be improved.

Since the generator 30 is interposed between the first-sage Stirling engine 2 and the second-stage Stirling engine 3, the respective camshafts 12 and 13 of the first-sage Stirling engine 2 and the second-stage Stirling engine 3 are short, resistant to torsion, lightweight and durable.

Figure 5:
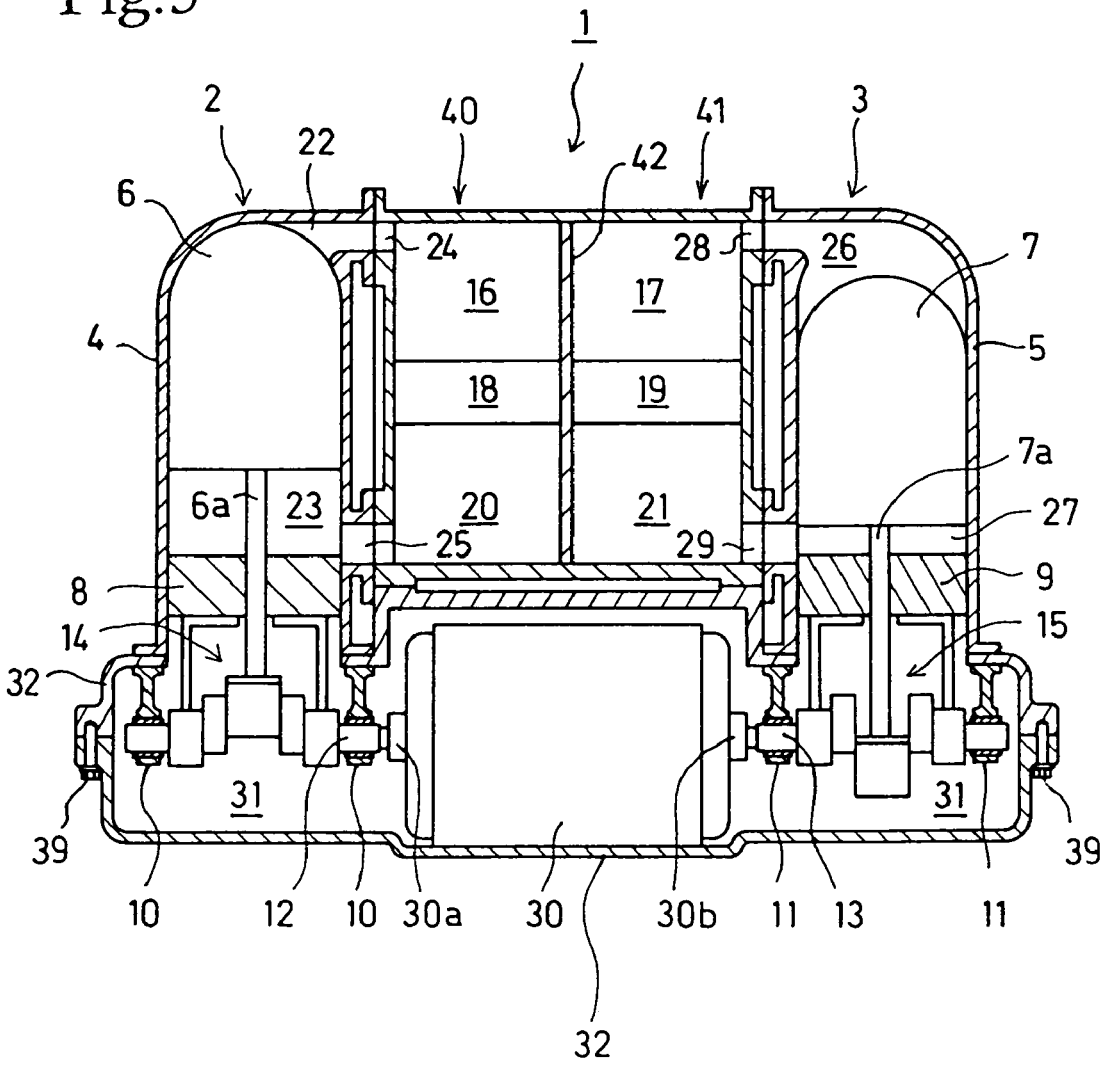
FIG. 5 is a longitudinal sectional view of a multistage Stirling engine in a second embodiment of the present invention.

Although the first heat exchanger 40 and the second heat exchanger 41 of the two-stage Stirling engine 1 shown in FIGS. 1 to 4 are formed separately, the first heat exchanger 40 and the second heat exchanger 41 may be installed in a single casing, and the interior of the casing may be divided into spaces respectively for the first heat exchanger 40 and the second heat exchanger as shown in FIG. 5 by a vertical partition wall 42 disposed at the middle of the casing with respect to a lateral direction as viewed in FIG. 5. When the first heat exchanger 40 and the second heat exchanger 41 are thus installed in the single casing, the number of component parts can be reduced, the construction can be simplified. Consequently, the two-stage Stirling engine 1 can be formed in small dimensions and can be manufactured at low cost.

Figure 6:
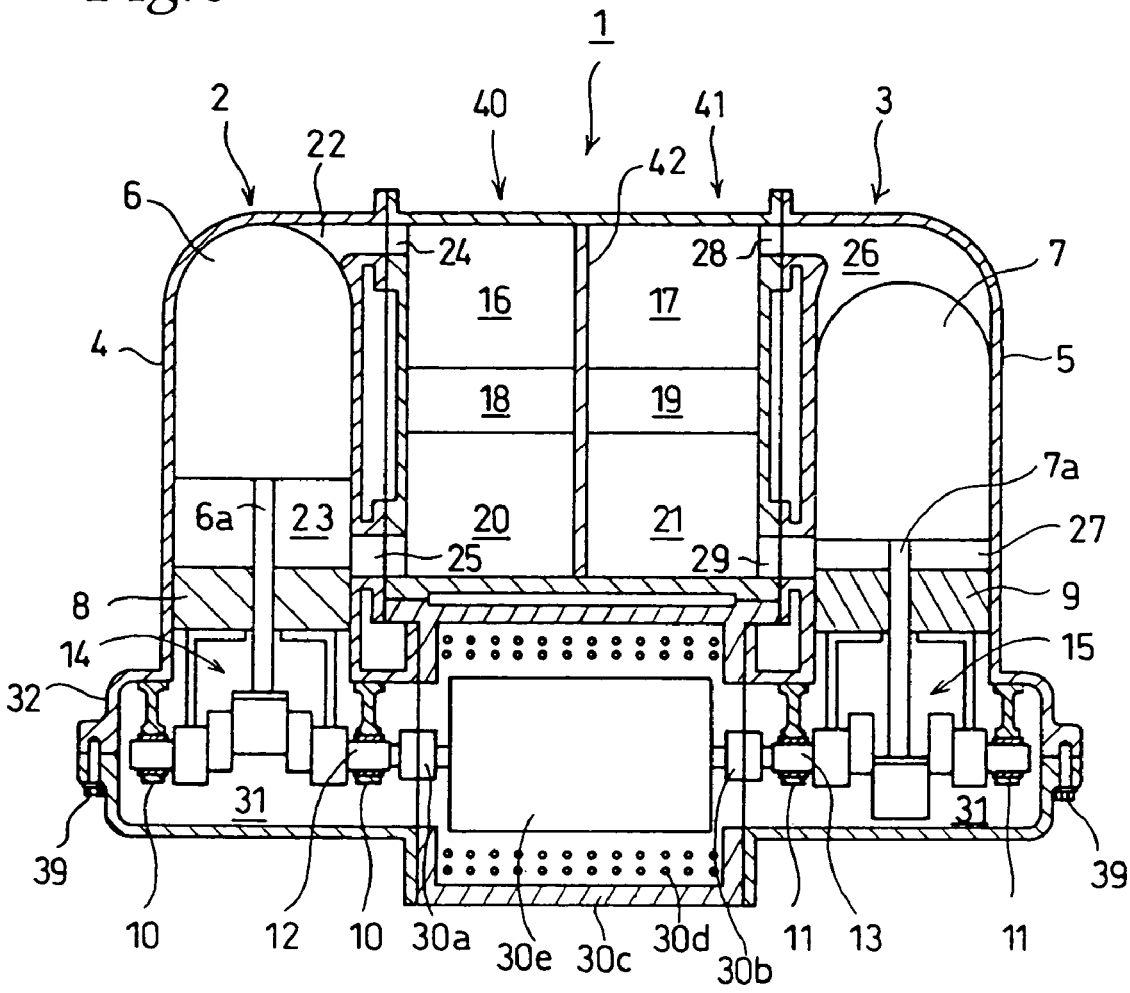
FIG. 6 is a longitudinal sectional view of a multistage Stirling engine in a third embodiment of the present invention.
Figure 7A:
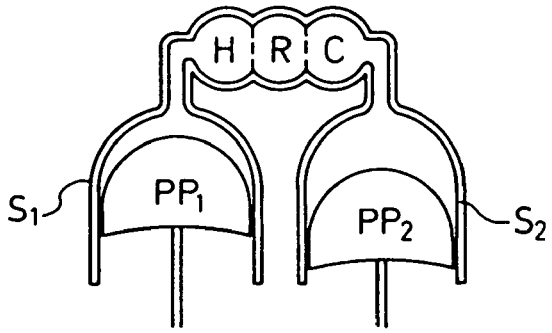
FIGS. 7A to 7D are schematic views of representative conventional Stirling engines classified by type.
Figure 7B:
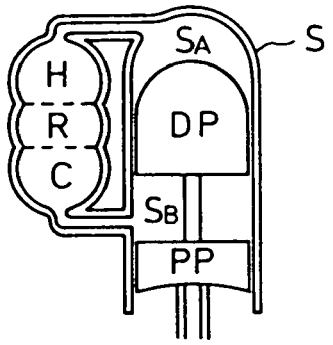
Figure 7C:
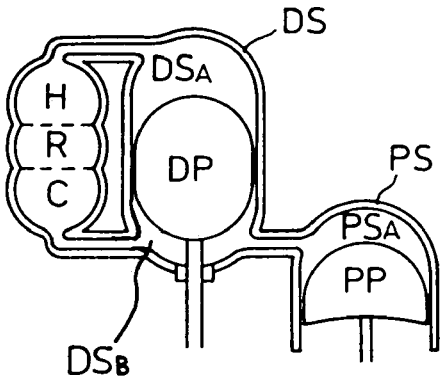
Figure 7D:
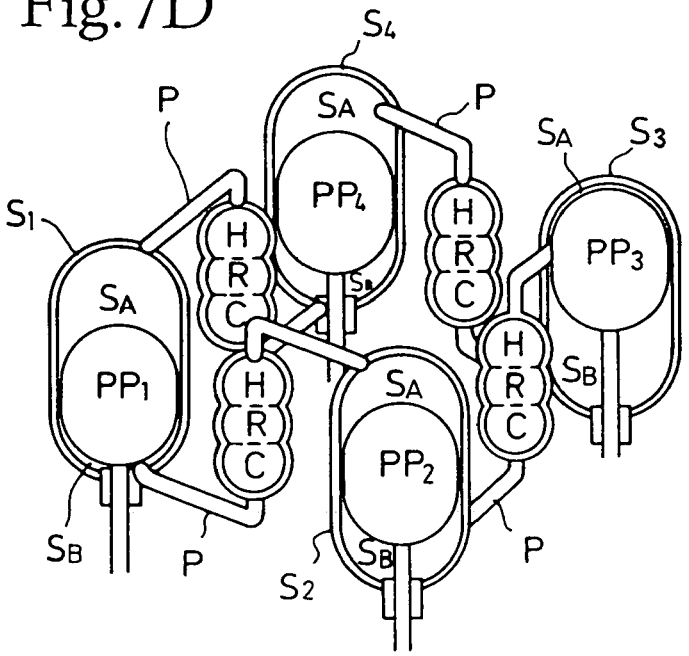

Although the generator 30 is installed in a crank chamber 31 defined by the crankcase 32 consisting of the upper and the lower half case in the two-stage Stirling engine 1 shown in FIGS. 1 to 4, the generator 30 may be provided with a highly rigid generator case 30*c*, and the generator case 30*c* may serve as part of the crankcase 32 as shown in FIG. 6. When the generator case 30*c* is used as part of the crankcase 32, the weight and material of the crankcase 32 can be considerably reduced to achieve considerable weight and cost reduction. As shown in FIG. 6, field coils 30*d* are attached to the inner circumference of the generator case 30*c*, and a rotor 30*e* is supported in a central part of the space in the generator case 30*c* by rotating shafts 30*a* and 30*b*.

The surfaces of the walls of the first heater 16 and the second heater 17 to be exposed to the exhaust gas may be coated with an exhaust gas cleaning catalyst to use the first heater 16 and the second heater 17 also as exhaust gas cleaning devices.

Although the invention has been described as applied to the β-type two-stage Stirling engine, the present invention is applicable to a multistage Stirling engine having three or more stages and any type of multistage Stirling engine provided with a plurality of displacer cylinders and a plurality of power cylinders.

The invention claimed is:

1. A multistage Stirling engine comprising: a plurality of cylinders each internally holding a working fluid and provided with a displacer piston and a power piston disposed in series and fitted in the cylinder; a plurality of heaters respectively combined with the cylinders to heat the working fluid contained in the plurality of cylinders and using a high-temperature heating fluid provided by a heat source; and a heating fluid passage for passing the heating fluid sequentially through the heaters;

wherein the plurality of cylinders include adjacent cylinders disposed in parallel arrangement; and wherein a plurality of heat exchangers are provided which comprise respectively said plurality of heaters, a plurality of coolers for cooling the working fluid within the plurality of cylinders, and a plurality of regenerators each interposed between an associated heater being one of the plurality of heaters and an associated cooler being one of the plurality of coolers; each of the plurality of heaters is connected to one end of each of the plurality of cylinders; each of the plurality of coolers is connected to the other end of each of the plurality of cylinders; the plurality of heat exchangers are each in the form of a stack of each heater, each regenerator and each cooler; and two of the heat exchangers forming adiacent stacks are interposed closely between adjacent two cylinders of the plurality of cylinders to form an integral structure having a shape of a flat rectangular solid including the adjacent cylinders and the heat exchangers.

2. The multistage Stirling engine according to claim 1, further comprising: output shafts connected to the displacer pistons and the power pistons fitted in the plurality of cylinders, a generator connected to the output shaft, and a case sealing the output shaft and the generator therein.

3. The multistage Stirling engine according to claim 2, wherein the multistage Stirling engine has an engine case and said case for sealing the output shaft and the generator is a part of the engine case.

4. The multistage Stirling engine according to claim 1, wherein the heating fluid is an exhaust gas discharged from an internal combustion engine, and said heating fluid passages include an upstream exhaust pipe extending on opposite sides of one of the cylinders and connected to opposite side parts of a heater combined with a same cylinder.

5. The multistage Stirling engine according to claim 1, wherein said heating fluid passages include a downstream exhaust pipe for carrying the exhaust gas after the exhaust gas has exchanged heat with the working fluid in one of the heaters, and the downstream exhaust pipe extends on opposite sides of another cylinder of the cylinders.

6. The multistage Stirling engine according to claim 2, wherein the output shafts connected to the respective displacer pistons and power pistons of the plurality of cylinders are aligned, and the generator is installed in alignment with the axes of the output shafts.

7. The multistage Stirling engine according to claim 1, wherein the plurality of heat exchangers are united in a unit.

* * * * *